United States Patent [19]

Tanaka et al.

[11] Patent Number: 4,767,967

[45] Date of Patent: Aug. 30, 1988

[54] HIGH VOLTAGE GENERATING DEVICE

[75] Inventors: Takeshi Tanaka, Toyohashi; Hiroshi Yorita, Nishio; Masahiro Tomita, Anjo; Toshihiko Igashira, Toyokawa, all of Japan

[73] Assignee: Nippon Soken, Inc., Nishio, Japan

[21] Appl. No.: 741,224

[22] Filed: Jun. 4, 1985

[30] Foreign Application Priority Data

| | | | |
|---|---|---|---|
| Jun. 5, 1984 | [JP] | Japan | 59-113865 |
| Jun. 19, 1984 | [JP] | Japan | 59-124440 |
| Nov. 28, 1984 | [JP] | Japan | 59-252745 |
| Mar. 15, 1985 | [JP] | Japan | 60-50643 |

[51] Int. Cl.[4] ..... H01T 13/00

[52] U.S. Cl. ..... 315/55; 315/209 R; 315/209 PZ; 310/318; 310/352

[58] Field of Search ..... 315/55, 209 PZ, 209 R; 310/318, 319, 352

[56] References Cited

U.S. PATENT DOCUMENTS

| | | | |
|---|---|---|---|
| 2,474,241 | 6/1949 | Garrison | 310/352 |
| 2,717,916 | 9/1955 | Harkness | 315/55 X |
| 3,215,133 | 11/1965 | Farrell | 315/55 X |
| 3,229,154 | 1/1966 | Crownover | 315/209 PZ |
| 3,247,423 | 4/1966 | Nolta et al. | 315/209 PZ |
| 3,361,929 | 1/1968 | Vandover | 315/55 |
| 3,584,245 | 6/1971 | Helfen | 310/352 |
| 3,691,410 | 9/1972 | Kawada | 310/318 |
| 3,900,766 | 8/1975 | Kawada | 310/318 |
| 3,948,238 | 4/1976 | Jamieson | 315/55 X |
| 4,025,817 | 5/1977 | Wollschleger | 315/209 PZ |
| 4,054,936 | 10/1977 | Ansai et al. | 310/318 |
| 4,382,203 | 5/1983 | Tribby et al. | 310/352 |
| 4,392,082 | 7/1983 | Harada | 315/55 |
| 4,412,151 | 10/1983 | Norris | 315/55 |
| 4,595,864 | 6/1986 | Stiefelmeyer | 315/209 PZ |
| 4,608,509 | 8/1986 | Yamamoto et al. | 310/352 |

FOREIGN PATENT DOCUMENTS 58-59370 4/1983 Japan .

OTHER PUBLICATIONS

English abstract of Japanese document No. 58-59370, 124 M 225.

*Primary Examiner*—David K. Moore
*Assistant Examiner*—Michael Razavi
*Attorney, Agent, or Firm*—Cushman, Darby & Cushman

[57] ABSTRACT

A high voltage generating device with a PZT element is disclosed. The device includes an energization control unit for generating an energization voltage, a PZT element unit for performing voltage conversion in response to an output from the energization control unit, and a load unit for receiving an output from the PZT element unit. The PZT element unit is provided with a resonating member and an electrostrictive element, and a period of an output voltage from the energization control unit is controlled so that a primary voltage from the PZT element unit becomes maximum at a timing when the output voltage from the energization control unit is not supplied.

8 Claims, 18 Drawing Sheets

HIGH VOLTAGE GENERATING DEVICE

BACKGROUND OF THE INVENTION

1. Field of the Invention

The present invention relates to a high voltage generating device. The device according to the present invention is used as a spark ignition device for an internal combustion engine.

2. Description of the Related Art

A use of a piezoelectric (PZT) element as a spark ignition device for an internal combustion engine has been proposed by, for example, the Clevite Corporation of the United States (See E. Crankshaw et al. "A Piezoelectric Ignition System for Small Engines" SAE-D244, 1961 SAE Summer Meeting). In this use, a mechanical stress is applied externally to the PZT element by utilizing an eccentric cam. In other words, mechanical stress is externally applied to and an electric charge is generated from the PZT element, and if an electrode is provided, the electric charge can be extracted as a voltage. However, in this method, since it is relatively difficult to control the operation of the cam, spark timing cannot be adjusted, repeated discharges cannot be generated, and the energy discharged from the PZT element is relatively low. To counteract noise interference with radio frequency reception, a demand has arisen for a distributor-less ignition device. In Japanese Patent Application No. 59-42967, a piezoelectric type spark ignition device was proposed by the same applicant as the present invention.

When a columnar PZT element is stretched or contracted in a resonance state in the axial direction, an electric charge is generated in the same manner as under the application of a mechanical stress. This generates a high voltage across electrodes at two ends of the PZT element. To cause the element to resonate, a voltage, rather than a mechanical stress is applied to the element, in such a manner that the element itself comes under stress due to electrostriction. This principle has been also adopted for a PZT transformer. That is, an alternating voltage is applied across a pair of opposing electrodes so that resonance is caused by a strain component in a direction perpendicular to the direction in which a voltage is applied, and an electric charge generated thereby is trapped by an electrode, thus generating a high voltage. Although strain in the voltage application direction is large, since the PZT transformer utilizes strain in the direction perpendicular to the voltage application direction, an electrode having a large area is required in order to obtain a large electrostriction. Thus, the electrode occupies at least half of the area of the PZT transformer.

SUMMARY OF THE INVENTION

It is an object of the present invention to realize a PZT element type compact high voltage generating device which can satisfactorily produce high energy by multiple discharges by utilizing the above-mentioned characteristics of a PZT element.

According to a basic aspect of the present invention, there is provided a high voltage generating device with a PZT element wherein electrodes are provided on end faces of a columnar PZT element, an alternating voltage is applied to one of the electrodes, and the other electrode is electrically connected to a discharge gap.

According to another aspect of the present invention, there is provided a high voltage generating device with a PZT element wherein bias control means for generating an alternating voltage as a bias voltage is provided, electrodes are provided on end faces of a columnar PZT element, the alternating voltage from the bias control means is applied to one of the electrodes, and the other electrode is electrically connected to a discharge gap.

According to still another aspect of the present invention, there is provided a high voltage generating device with a PZT element wherein bias control means for generating a bias voltage, PZT element means having a PZT element, a resonating member, and an electrostrictive element, and receiving an output from the bias control means, and load means for receiving an output from the PZT element means, are provided, and a period of an output voltage of the bias control means is controlled so that a primary voltage of the PZT element means becomes maximum when the output voltage from the bias control means is not supplied.

DESCRIPTION OF THE PREFERRED EMBODIMENTS

Figure 1:
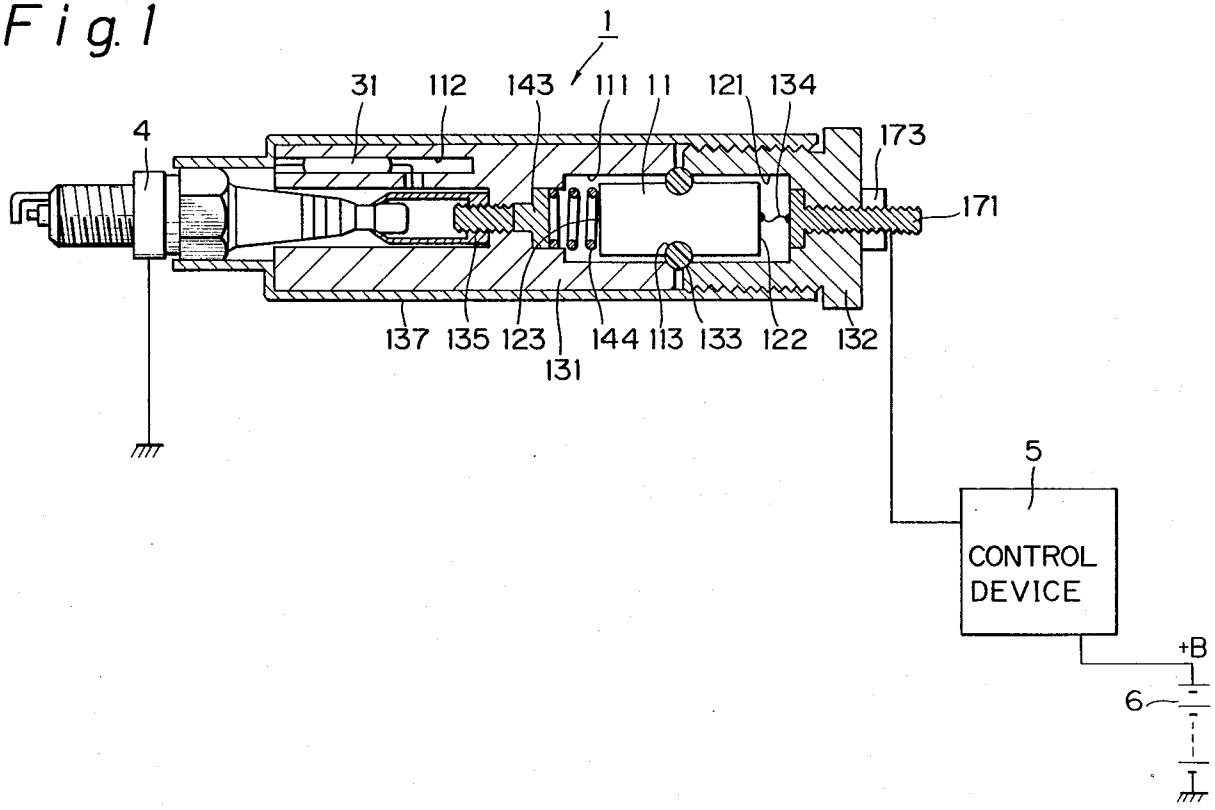
FIG. 1 is a sectional view showing a high voltage generating device used for a spark ignition device having a PZT element according to an embodiment of the present invention.

FIG. 1 shows a high voltage generating device used for a spark ignition device having a PZT element according to an embodiment of the present invention. Referring to FIG. 1, reference numeral 1 denotes an ignition device main body; 4, a spark plug for a normal internal combustion engine; and 5, a control device. A columnar PZT element has an annular groove 113 at the center in the axial direction, and is made of, e.g., lead zirconium titanate (PZT). Electrodes 122 and 123 of, e.g., silver paste, are baked onto two ends of the PZT element 11. An insulator 131 made of an electrically insulating material, e.g., polyphenylene sulfide, is housed in a housing 137 made of steel and is tightened through an insulator cap 132, made of the same material as that of the insulator 131, and a resin element holder 133. A stepped cylindrical hole 111 is formed in the insulator 131 in the axial direction, and a cylindrical hole 112 is formed in the insulator 131 in parallel to the hole 111 and at the side of the spark plug 4. A cylindrical hole 121 is formed along the central axis of the insulator cap 132.

The element holder 133 has a partially notched ring shape, and is fitted and held in the groove 113 by utilizing the elasticity of the resin material thereof. The outer peripheral portions of the holder 133 are enclosed and held by the tapered end face portions of the insulator 131 and the insulator cap 132, respectively, and thus holds the PZT element 11 in position by the groove 113 therein. Namely, the PZT element 11 is mainly supported at this groove 113 formed at the center thereof. A wire 134, as a small-mass conductive material, is soldered at one end to the silver paste 122 on the end face of the PZT element and at the other end to a metal electrode terminal 171.

The electrode terminal 171 is fixed to the insulator cap 132 by a nut 173. A stem 143 has a stepped cylindrical shape, and a small-diameter portion thereof is threaded. The stem 143 is made of a conductive material, e.g., steel, and is electrically connected to the end face of the electrode 123 of the PZT element 11 through a small-mass spring 144. The threaded portion of the stem 143 is engaged with a threaded portion of a stem holder 135. The stem holder 135 is made of a conductive material, e.g., steel, and has a cylindrical shape tapered at the bottom. The holder 135 is fitted in the hole 111 from the spark plug side. A high withstand voltage diode 31 is built into the hole 112 of the insulator 131, and has terminals connected to the housing 137 and the stem holder 135, respectively.

Operation of the device shown in FIG. 1 will be described hereinafter. A signal (to be described later) is generated from the control device 5 in synchronism with the rotation of an engine and a resonance period of the PZT element. The signal is supplied to the PZT element 11 through the electrode terminal 171 and the wire 134. The PZT element 11 is supported by the element holder 133 at its central portion, and the spring 144 is in weak contact with the element 11 to minimize any external mechanical force. Thus, when the PZT element 11 receives an input voltage of about 800 V having the required resonance period, it generates an output voltage of about 20 to 30 kV. The output voltage is applied to the spark plug 4 through the spring 144, the stem 143, and the stem holder 135. The diode 31 is provided for effectively utilizing the output voltage from the element 11.

Figure 2:
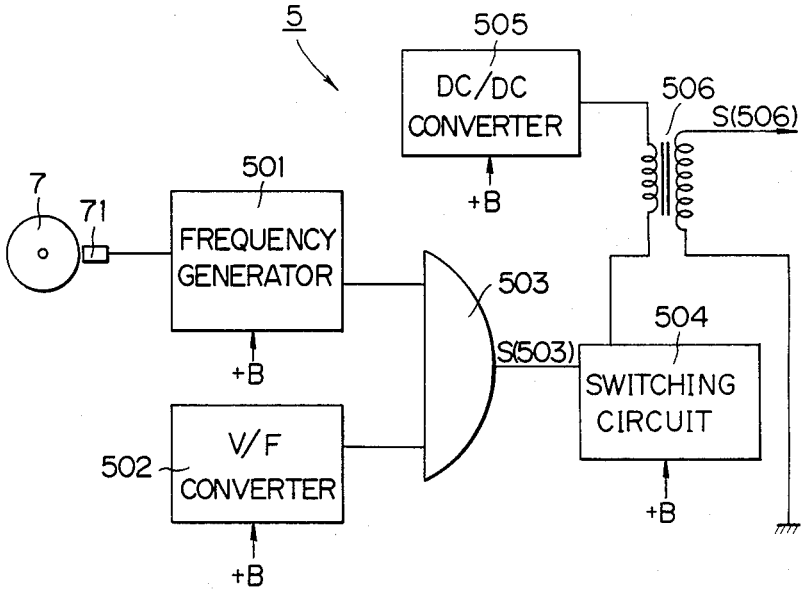
FIG. 2 is a view showing an arrangement of a control circuit in the device shown in FIG. 1.
Figure 3:
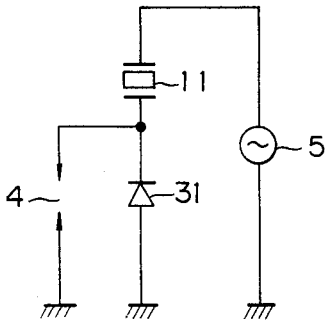
FIG. 3 is a view showing an equivalent circuit of the device shown in FIG. 1.
Figure 4:
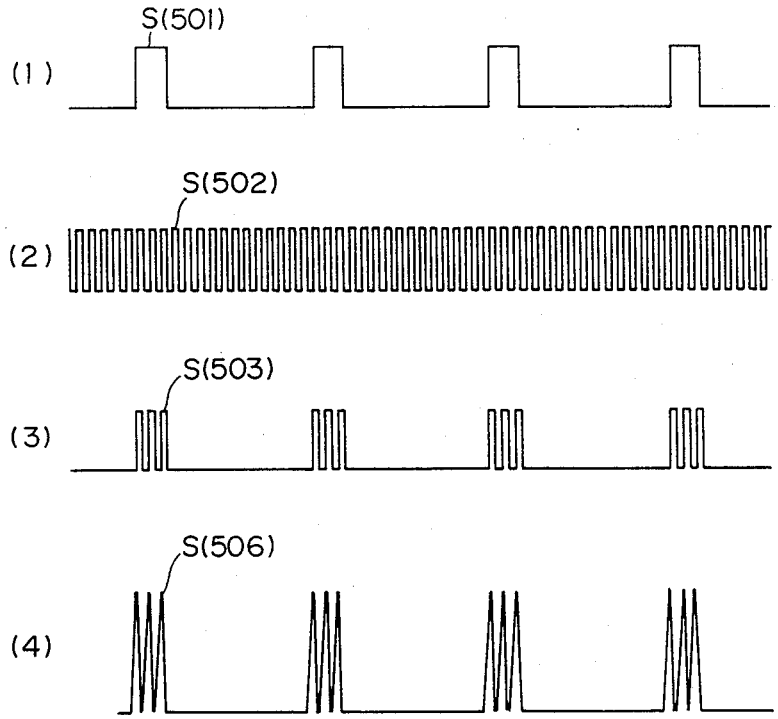
FIG. 4 is a view showing signal waveforms of respective portions of the control circuit shown in FIG. 2.

FIG. 2 shows the control device of the device shown in FIG. 1, and FIG. 3 shows an equivalent circuit of the device shown in FIG. 1. An input voltage is applied to the PZT element 11 through a capacitance of the spark plug 4. In this case, the total input voltage is not applied to the plug 4, that is, the application voltage is obtained by (the input voltage)$\times$C1/(C1+C2), where C1 is a capacitance of the plug and C2 is a capacitance of the PZT element. The operation of the control device 5 shown in FIG. 2 will be described hereinafter. The rotation sensor 71 in association with the rotation shaft 7 delivers a rotation signal. An oscillator 501 generates a signal S(501) shown in FIG. 4(1) once for every two rotations of the engine. An oscillator 502 generates a signal S(502) shown in FIG. 4(2) in synchronism with the resonance period of the PZT element. These signals are synthesized by an AND circuit 503 to become a signal S(503) shown in FIG. 4(3). The signal S(503) is supplied through a switching circuit 504, a DC/DC converter 505, and a transformer 506, thus obtaining an input signal S(506) having a desired potential, as shown in FIG. 4(4).

Figure 5:
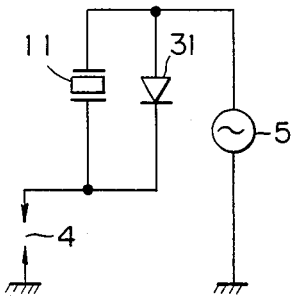
FIGS. 5, 6, 7, and 8 are views for explaining other embodiments of the present invention, respectively.

In addition to the above embodiment, various changes and modifications may be made within the spirit and scope of the invention. For example, if the diode is connected in parallel with the PZT element without grounding one end, as shown in FIG. 5, the same effect as in the above embodiment can be obtained.

Figure 6:
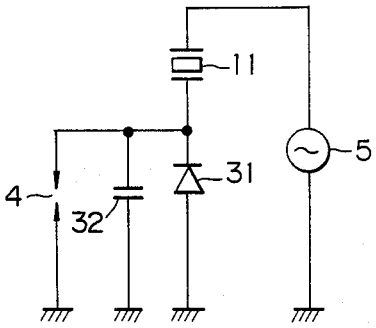
Figure 7:
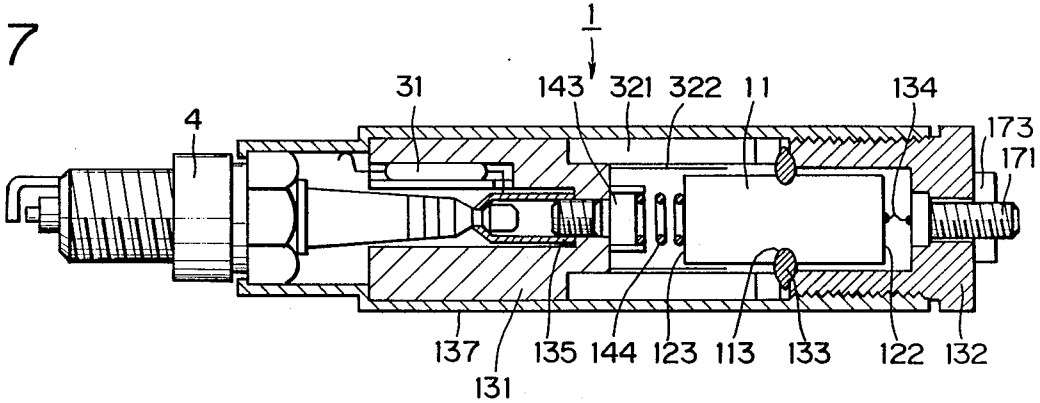

FIG. 6 shows another embodiment of the present invention. In the embodiment shown in FIG. 6, a capacitance C of a capacitor 32 is provided between an output electrode and a ground terminal, i.e., in parallel to the spark plug. FIG. 7 shows an arrangement of the embodiment shown in FIG. 6. A dielectric member 321 has a cylindrical shape and is made of a material having a high dielectric constant, e.g., lead zirconium titanate (PZT), which is not subjected to polarization. The dielectric member 321 is sandwiched between an insulator 131 and an insulator cap 132 inside a housing 137. A capacitor electrode 322 has a cylindrical shape with a bottom, and is made of a conductive material, e.g., copper, steel or the like. The capacitor electrode 322 is brought into tight contact with the insulator 131 by a stem 143. The dielectric member 321, the capacitor electrode 322, and the housing 137 constitute the capacitor 32.

When the high voltage generated for spark discharge is supplied to the spark plug, a capacitance of the spark plug should be decreased in order to maintain a sufficient breakdown voltage. This applies in common to a dielectric discharge method, a capacitive discharge method, and an ignition device using a PZT transformer.

However, as in the above embodiment, when an electric charge is generated due to resonance of the PZT element itself using an electrical input, a proper capacitance must be provided in order to supply the input voltage and to derive the output voltage. However, when the capacitance of the spark plug is lower than the proper value, an additional capacitance must be provided in parallel to the spark plug.

According to an experiment conducted by the present inventor, when the capacitance of the PZT element was 70 pF and a 20 pF capacitor was added thereto, the output voltage was doubled at an optimal efficiency. Note that the capacitance of the spark plug was 15 pF. As described above, the capacitance of the spark plug tends to be generally decreased. However, in the device shown in FIG. 6 or 7, the capacitance of the spark plug is increased, resulting in an increase in the output voltage.

Figure 8:
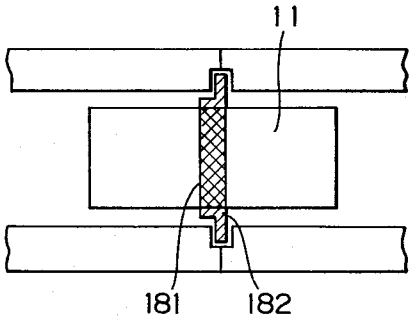

In another embodiment of the present invention, as shown in FIG. 8, when the PZT element 11 has a sufficient length with respect to the output voltage, the periphery of the central portion of the element 11 is metallized to form a metallizing layer 181, and a supporting frame 182 is brazed to the layer 181, thus supporting the element 11.

Unlike a conventional PZT transformer, in the above embodiments the element is provided with only two electrodes (e.g., the conventional PZT transformer has three or more electrodes), and utilizes electrostriction acting in the same direction as the voltage application direction. Accordingly, the area of the electrodes can be decreased, thus achieving a compact element.

Figure 9:
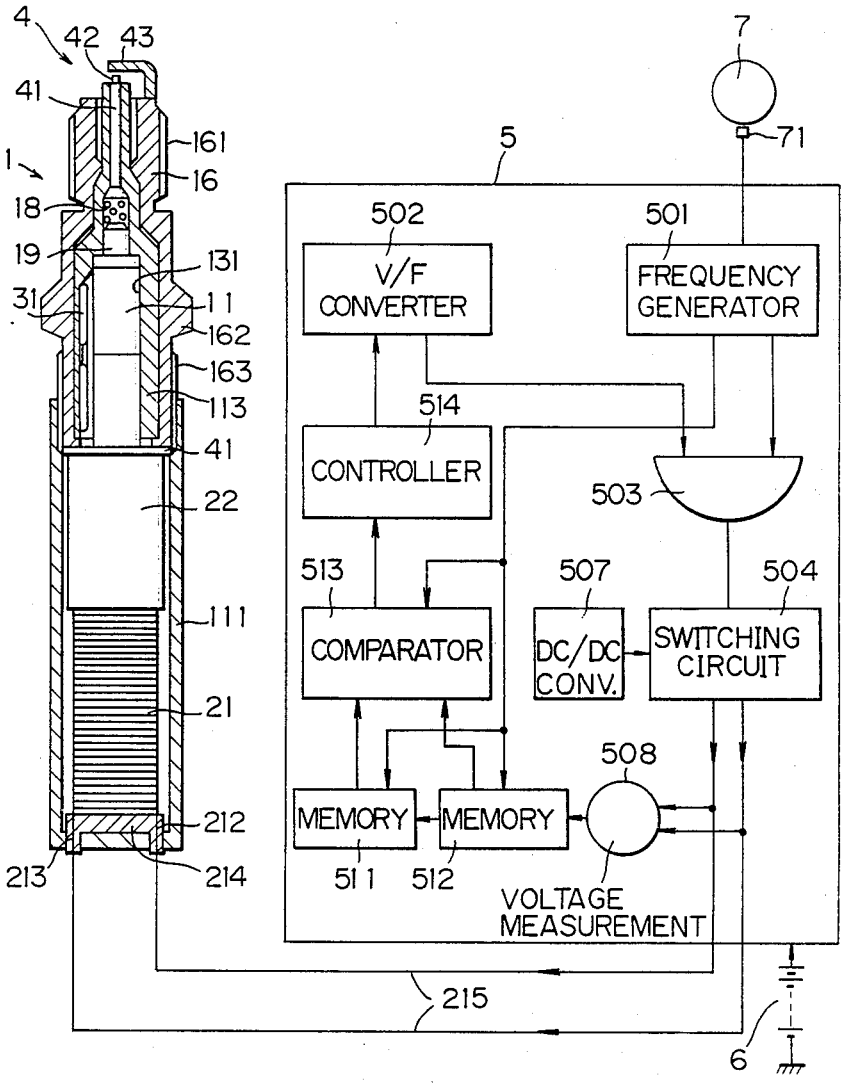
FIG. 9 is a view showing still another embodiment of the present invention.

FIG. 9 shows a spark ignition device according to still another embodiment of the present invention. In the spark ignition device shown in FIG. 9, a PZT element 11 has a columnar shape. An electrostrictive element stack 21 comprises multilayered thin PZT electrostrictive elements stacked along its axial direction, and each thin PZT electrostrictive element has thin electrode films on two surfaces thereof. Both the PZT element and electrostrictive elements are made of a lead zirconium titanate (PZT) material. Although these elements have the same major component, they have different additional components, thus making a difference between the PZT element suitable for a PZT function and the electrostrictive element suitable for an electrostrictive function.

The electrodes of the electrostrictive element stack 21 are divided into two groups, and terminals 213 and 214 are connected to each of the two groups, respectively. Lead wires 215 are connected to the terminals 213 and 214. The insulator 113 is made of an electrically insulating material, e.g., alumina ($Al_2O_3$). A cylindrical stepped through hole 131 is formed in the insulator 113 in the axial direction, and a resonating material 22 has a cylindrical shape, and is made of alumina having good acoustic characteristics. In the resonating material 22, one of a pair of surfaces parallel to each other is pressed against the PZT element 11 and the other surface is pressed against the electrostrictive element stack 21. The electrostrictive element stack 21, the resonating element 22, and the PZT element 11 constitute a converter portion. A supporting member 214 is provided on a bottom surface of the electrostrictive element stack 21.

The insulator 113 is fitted in a housing 16 and is held at an opening thereof. The housing 16 is made of steel, and has a threaded portion 161 on a side surface at the side of an electrode and a hexagonal prism portion 162 near the center portion of the periphery thereof. The housing 16 also has a threaded portion 163 at the side of the PZT element. A steel center electrode 41, a glass seal 18, and a steel stem 19 are fixed in the through hole 131 of the insulator 113, in that order, from the distal end thereof. In addition, the PZT element 11 is detachably inserted in the through hole 131. The stem 19 also serves as an electrode plate, and a length from one end face, that is, the electrode portion, to an entrance of the hole 131, is slightly larger than that of the PZT element 11. A ground electrode 43 is arranged at the distal end of the housing 16 so as to oppose the center electrode 41, thus forming a small gap, that is a discharge gap 42, therebetween. A vibrating portion housing 111 is made of steel, and has a cylindrical shape with a bottom. The housing 111 has a threaded portion on an inner surface near an opening thereof, which is engaged with a threaded portion 163 of the housing 16. A diode 31 is inserted as shown in FIG. 9.

In a control device 5, reference numeral 501 denotes a frequency generator; 502, a V/F converter; 503, an AND circuit; 507, a DC/DC converter; 504, a switching circuit; 508, a peak hold voltage measurement circuit; 511 and 512, memories; 513, a comparator; and 514, a controller.

Figure 11:
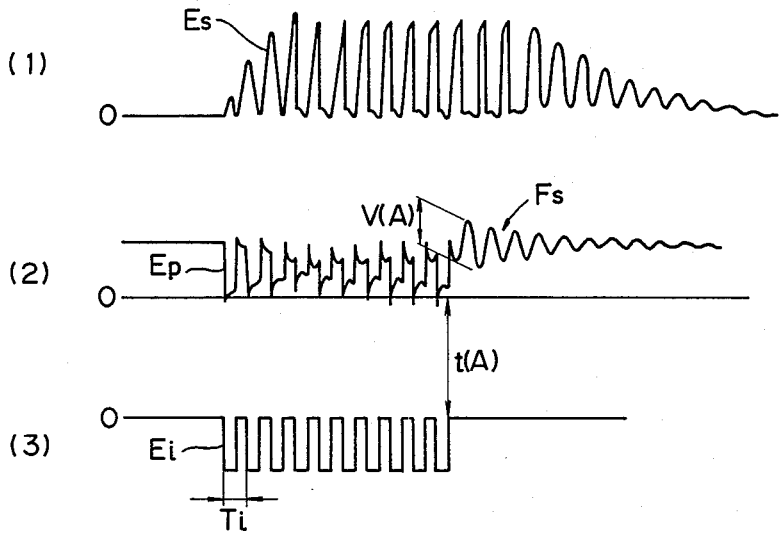

Referring to FIG. 9, the electrostrictive element stack 21 is stretched/contracted by an alternating voltage in the axial direction. The stretching/contraction is amplified by the reasonating material 22, and transmitted to the PZT element 11. The PZT element 11 receiving this mechanical stress generates a high voltage as a secondary voltage. The secondary voltage becomes the high voltage only when an alternating voltage having a resonance frequency is applied to the primary side. However, according to an experiment of the present invention, it was found that, in the spark ignition device using the PZT element, a resonance frequency Fr was changed in accordance with a change in temperature TEMP. When the alternating voltage as a control device output is applied to the electrostrictive element stack 21 and the primary voltage appearing at the terminal thereof is measured, the resonance frequency is changed due to the influence of the capacitance of the stack 21 and the PZT effect, as shown in FIG. 11. In this case, immediately after the control device output is cut off, i.e., even at a point t(A) in FIG. 11, a voltage V(A) is generated as the primary voltage by the influence of the stack 21.

Figure 12:
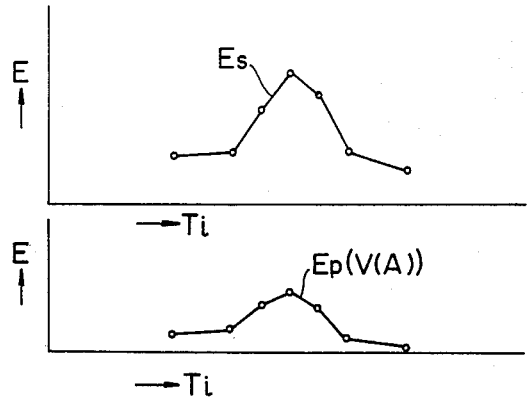
Figure 13:
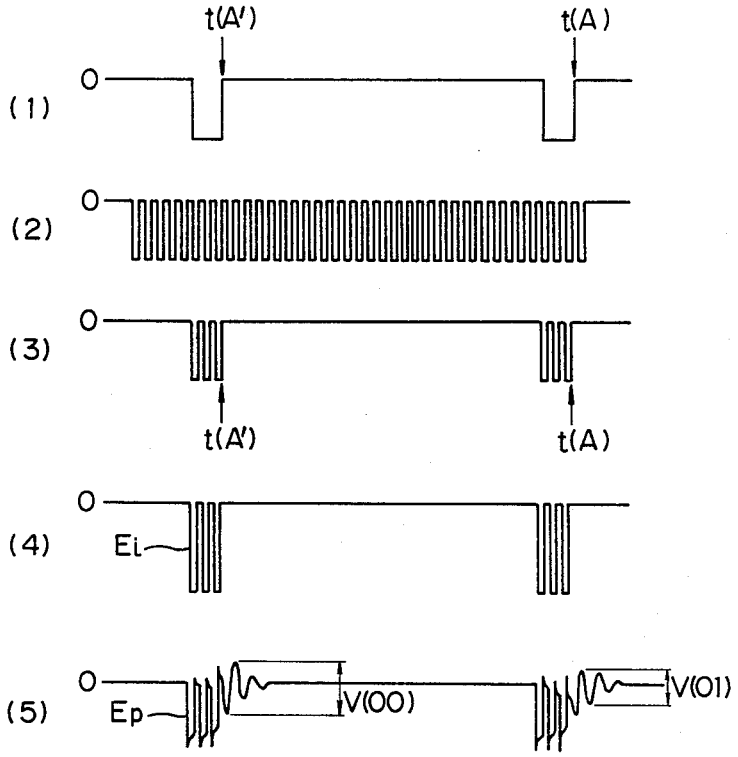
FIG. 13 is a waveform chart showing signal waveforms of the device shown in FIG. 9.

As shown in FIG. 12, the voltage V(A) becomes maximum with respect to the output voltage of the resonance frequency from the control device. Referring to FIG. 12, the abscissa indicates a period Ti of the output voltage from the control device, and the ordinate indicates a voltage E. The upper portion of FIG. 12 shows the secondary voltage $E_s$, while the lower portion of FIG. 12 shows the primary voltage of the V(A) portion $E_p(V(A))$. The control device 5 shown in FIG. 9 measures the voltage V(A) at a timing corresponding to the point t(A) in FIG. 11, and controls the output period thereof to maintain a resonance state of the ignition device. The generator 501 in FIG. 9 generates a signal once every two rotations of an engine ENG (as shown in FIG. 13(1)). The V/F converter 502 in FIG. 9 generates a signal having a voltage period near the resonance frequency of the ignition device, as shown in FIG. 13(2). These two signals are synthesized to become a signal shown in FIG. 13(3) by the AND circuit 503. Then, the output voltage of the control device shown in FIG. 13(4) can be obtained by the DC/DC converter 507 and the switching circuit 504. At this time, the primary voltage shown in FIG. 13(5) is measured by the peak hold measurement circuit 508.

The memory 512 stores a voltage V(01) measured by the peak hold measurement circuit 508 at a timing of t(A) in FIG. 13(1) in response to the signal from the generator 501. Simultaneously, the memory 512 transmits a previous measurement value V(00) to the memory 511. The comparator 513 detects a difference $\Delta V(0)$ between the values V(01) and V(00) in the memories 511 and 512. Note that the difference $\Delta V(0)$ is a positive value when the primary voltage is increased by changing its period. Conversely, when the primary voltage is decreased, the difference $\Delta V(0)$ is a negative value. The controller 514 determines a period control voltage V using the difference $\Delta V(0)$ in accordance with $\Delta V = C \times V(0) \times \Delta V$ and $V = V + \Delta V$, where C is a proportionality constant, and when high-speed control is performed, it is set to be a high value, while, when fine control is performed, it is set to be a low value. Furthermore, the V/F converter converts the period control voltage V into a period. Thus, the primary voltage at a point when the control device output is cut off is fed back to compensate for the resonance frequency.

Figure 14:
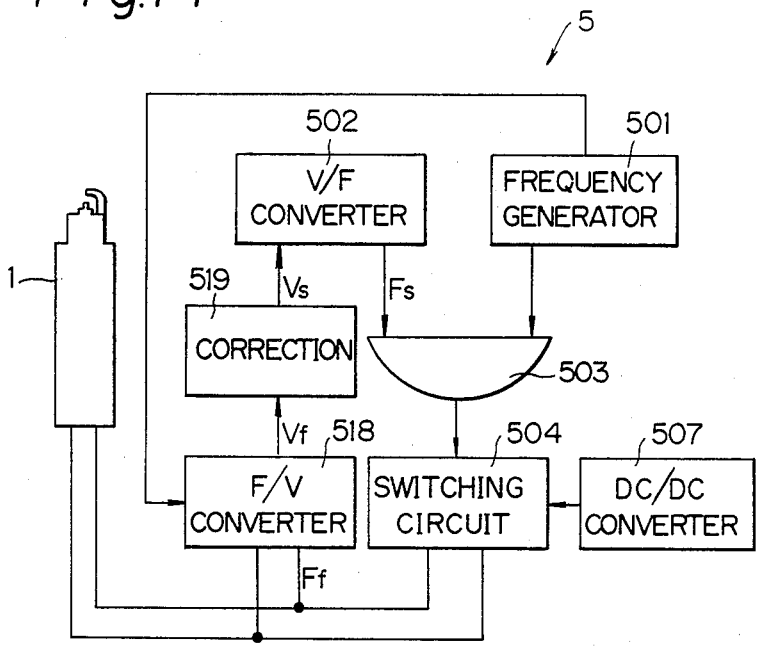
FIGS. 14, 15, 16, and 17 are views for explaining other embodiments, respectively.
Figure 15:
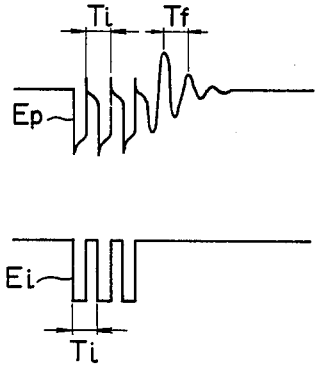

In addition to the above embodiment, various changes and modifications may be made within the spirit and scope of the invention. For example, the present invention can be modified as shown in FIG. 14. Referring to FIG. 14, an F/V converter 518 and a correction unit 519 are provided instead of the peak hold voltage measurement circuit, the memories, the comparator, and the controller in FIG. 9. FIG. 15 shows a primary voltage waveform.

When the control device output is applied, the primary voltage is changed at a period Ti of the control device output. This period Ti corresponds to a frequency Fi of the control device output. When the control device output is cut off, the primary voltage is changed at a free vibration period Tf. The period Tf corresponds to a free vibration frequency Ff. Note that the resonance period Tr is near the free vibration period Tf. The resonance period Tr corresponds to the resonance frequency Fr. The F/V converter 518 shown in FIG. 14 converts the free vibration frequency Fr of the primary voltage into a corresponding voltage Vf. The correction unit 519 adds a correction value $\Delta V$ measured in advance to the voltage Vf to synthesize a voltage Vs corresponding to the resonance frequency Fs, and supplies the voltage Vs to the V/F converter.

Figure 16:
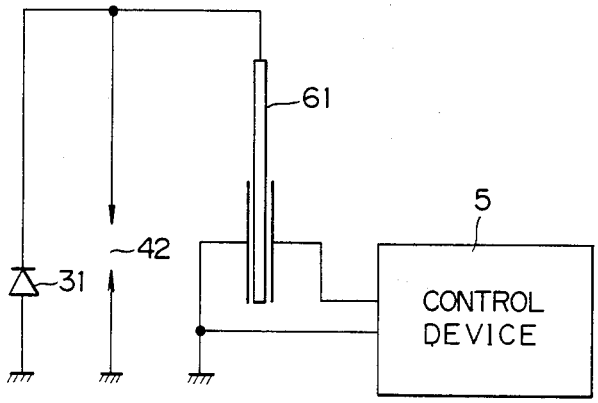

As an embodiment as shown in FIG. 16, a PZT transformer 61 can be used in a high voltage generating portion.

Figure 17:
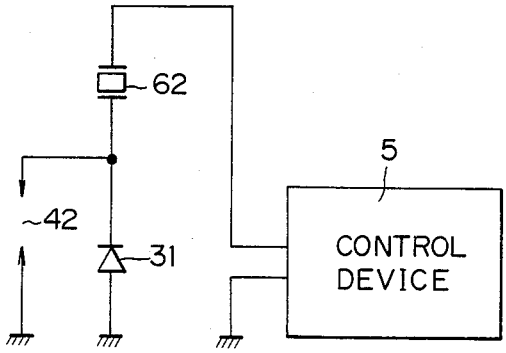

In another embodiment, as shown in FIG. 17, a PZT element having a columnar or polygonal shape and having electrodes on the upper and lower parallel surfaces thereof is used, the alternating voltage is applied to one of the electrodes and the other electrode is electrically connected to the discharge gap 42.

In the above embodiment, the frequency of the control device output in the ignition device comprising the PZT element or transformer is controlled. The present invention is not limited to this embodiment. Namely, if a spark ignition device comprising a high voltage generating means having a resonance frequency is provided, a frequency of a control device output can be controlled in accordance with a primary voltage at a timing when the control device output is cut off.

The device shown in FIG. 9 is proposed based upon the following.

Figure 10:
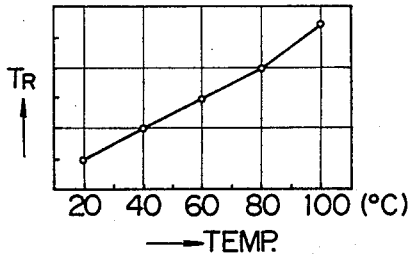
FIGS. 10, 11, and 12 are graphs showing characteristics of the device shown in FIG. 9.

According to an experiment of the present inventor, as shown in FIG. 10, in the spark ignition device using the PZT element, the resonance period Tr is changed in accordance with a change in temperature TEMP, and an output voltage is decreased. In the spark ignition device using the PZT element, such a decrease in the output voltage by a change in resonance frequency due to a change in temperature is undesirable. However, conventionally, such a problem cannot be satisfactorily resolved. In the device shown in FIG. 9, the period of the primary voltage is controlled based upon the fact that the primary voltage becomes maximum in the resonance mode at the timing when the control device output is cut off, and the spark ignition device using the PZT element is kept in the resonance state irrespective of changes in the temperature, thus stabilizing the output voltage from the ignition device.

Figure 18:
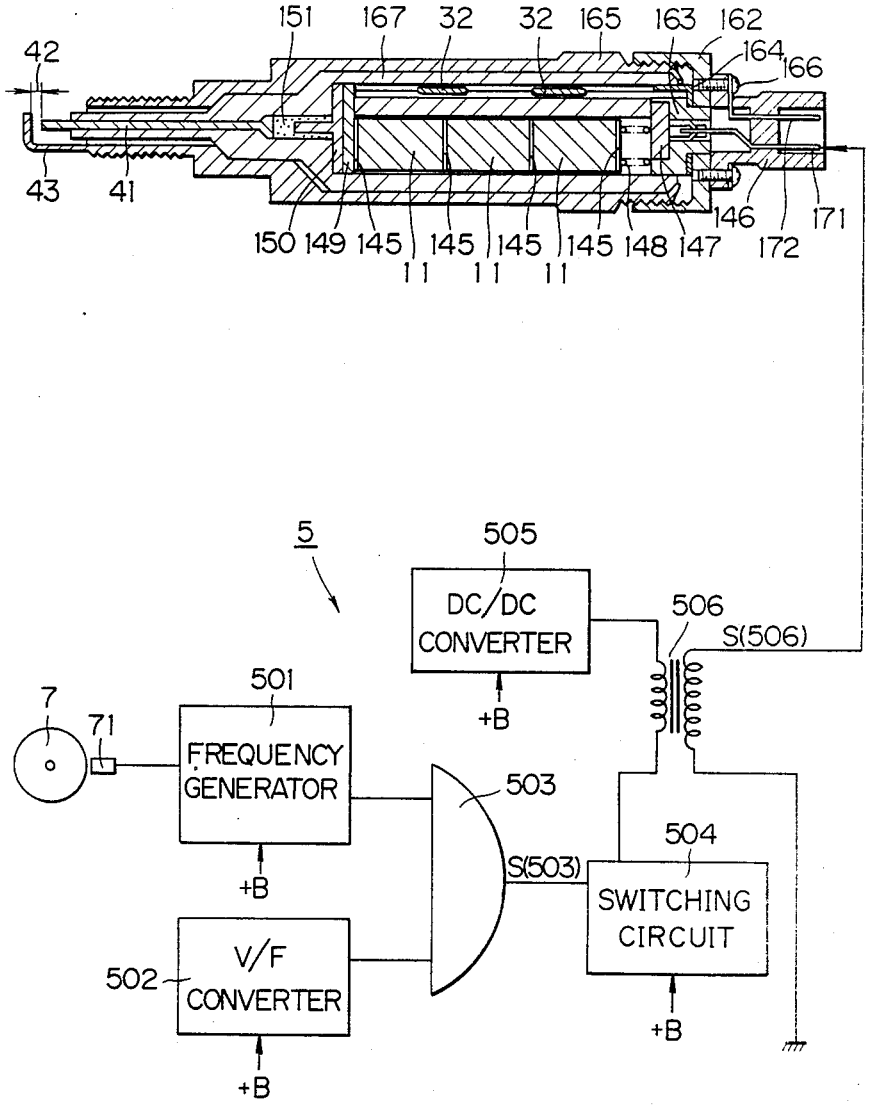
FIG. 18 is a view showing a further embodiment of the present invention.

FIG. 18 shows still another embodiment of the present invention, in which reference numerals 11 denotes at least two columnar PZT elements. The three PZT elements 11 having the same size are serially inserted in a cylindrical hole within a insulator 167 made of an insulating material (e.g., alumina). Each PZT element 11 comprises known oxides of lead, zircon, and titanium, and the two end faces thereof are closed by silver compounds. Thin disk plates 145 made of a soft metal, e.g., copper, are provided on electrode end faces of the respective PZT elements. The PZT elements 11 are butted against each other by a relatively small biasing force of a spring 148. A center electrode 41 and a ground electrode 43 form a discharge gap 42 in the same arrangement as in a normal spark plug for an internal combustion engine. The PZT elements 11 and the discharge gap 42 are electrically connected through the thin disk plates 145, high voltage side electrodes 149 and 150, a glass seal 151 and the center electrode 41. The center electrode 41 and the high voltage side electrode 150 are sealed to each other by the glass seal 151. Reference numeral 32 denotes a high voltage withstanding diode, which is connected in parallel with the PZT elements. A connector 146 is made of an insulative resin, and has a connector positive terminal 171 and a connector ground terminal 172. The connector positive terminal 171 is electrically connected to the PZT elements 11 through a signal side electrode terminal 147 and the spring 148. The connector ground terminal 172 is connected together with one end of the diode 32 to a housing 165 made of a metal and a housing cap 162 made of the same material as that of the housing 165. A portion of the housing cap 162 is insulated by a terminal holder 163 from a portion electrically connected to the connector positive terminal 171.

Figure 19:
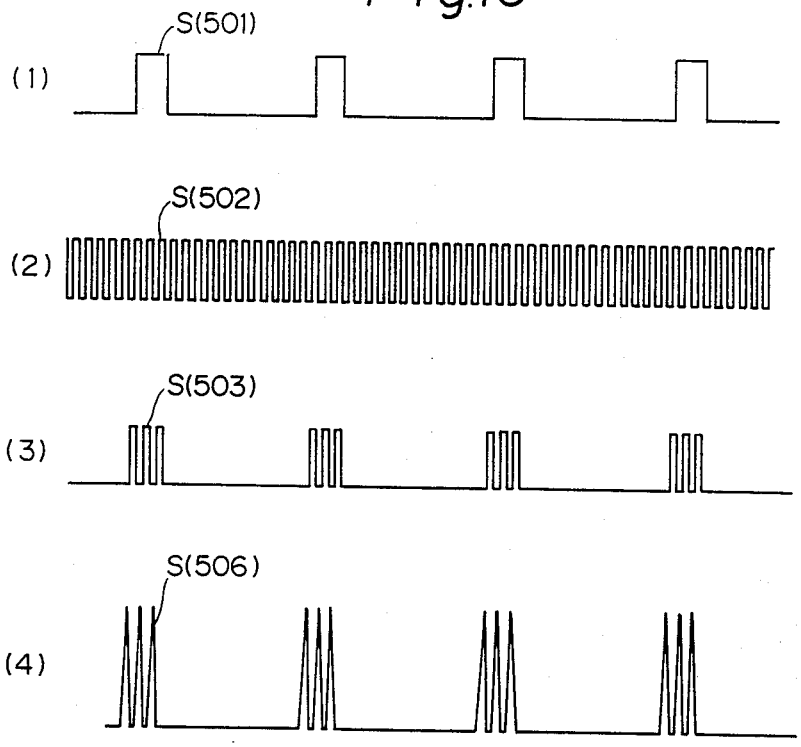
FIG. 19 is a view showing signal waveforms of respective portions of the device shown in FIG. 18.

The input voltage is applied to the PZT elements 11 through a capacitance of the discharge gap 42. In this case, the total input voltage is not applied to the PZT elements, that is, the application voltage is obtained by the input voltage$\times$C1/(C1+C2) (where C1 is a capacitance of the gap, and C2 is a capacitance of the PZT elements). Operation of a control device 5 will be described hereinafter. A frequency generator 501 generates a signal S(501) shown in FIG. 19(1) once every two rotations of an engine. A V/F converter 502 generates a signal S(502) shown in FIG. 19(2) at a resonance period of the PZT elements. These two signals are ANDed by an AND circuit 503, thus obtaining a signal S(503) shown in FIG. 19(3). The signal S(503) is supplied to a switching circuit 504, a DC/DC converter 505, and a transformer 506, thereby obtaining an input signal S(506) having a desired voltage shown in FIG. 19(4).

A stray capacitance C1 of the discharge gap is a capacitance formed between the center electrode 41, the high voltage side electrode 149, and the housing 165.

The operation of the device with the above arrangement will be described hereinafter.

An alternating voltage corresponding to a resonance frequency of the PZT elements is applied to the connector terminal 171. The voltage is applied to the PZT elements 11 through the electrode terminal 147 and the conductive spring 148. The spring 148 holds all the PZT elements by biasing them with a small force so as not to restrict resonance of the PZT elements 11. Since the PZT elements 11 have substantially the same shape, they simultaneously resonate in response to the alternating voltage having a specific period. Since each PZT element is compact in size, it cannot be easily broken, and since the copper disk plates 145 are held between each two adjacent elements 11, the elements 11 have less friction. Thus, since the PZT elements are aligned in series with each other, the output voltages from respective elements are added to each other, and a high voltage is generated. Accordingly, the high voltage is applied to the discharge gap 42 through the plates 145, the high voltage side electrodes 149 and 150, the glass seal 151, and the center electrode 41, thus generating a spark discharge at the discharge gap 42.

Note that the resonance frequency of the PZT element is mainly determined by a length of the element. In the device shown in FIG. 18, since each element has a short length, the resonance frequency is very short. For example, according to an experiment of the present inventor, when the length of the element is 15 mm, the resonance frequency is 8 to 10 μsec, and the resonance frequency remains substantially the same even if the number of elements is changed. Thus, when PZT elements having a short length ar connected in series along their longitudinal direction, a high voltage having a high frequency can be obtained. The high frequency high voltage has a low breakdown voltage, and is used in a known breakdown electrode for TIG welding. Therefore, the spark ignition device shown in FIG. 18 has a voltage sufficient for that required for discharge.

When the high voltage generated for spark discharge is to be supplied to the discharge gap, a capacitance of the discharge gap must be decreased in order to maintain a sufficient breakdown voltage. This applies to a dielectric discharge method, a capacitive discharge method, and to an ignition device using a PZT transformer.

However, as in the device shown in FIG. 18, when an electric charge is generated by resonance of the PZT element itself due to an electric input, a proper capacitance is inevitably required for supplying an input voltage and extracting an output voltage. However, when the discharge gap has a capacitance smaller than the proper value, a capacitance must be added in parallel therewith.

According to an experiment of the present inventor, in the device shown in FIG. 18, when the capacitance of the PZT element is 70 pF, if a capacitance of 15 pF is added thereto, doubling of the output voltage is carried out at a highest efficiency.

Therefore, a capacitance of a normal spark plug gap can be used as the capacitance C1.

Figure 20:
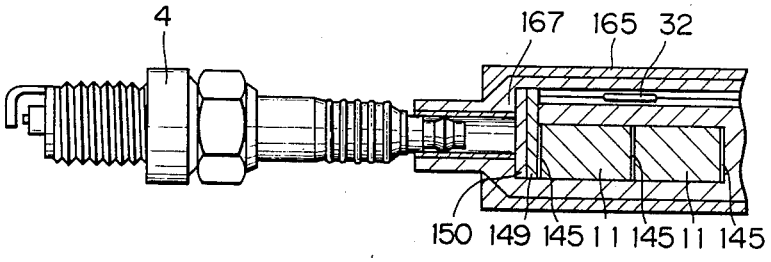
FIG. 20 is a view showing another embodiment.

FIG. 20 shows still another embodiment of the present invention, in which a high voltage side electrode is electrically connected to a stem of a normal spark plug.

When PZT elements having different elasticity constants are used, if they have substantially the same resonance frequency due to a difference in their shapes, the same arrangement as in the device shown in FIG. 18 can be achieved.

Furthermore, in the device shown in FIG. 18, the conductive spring 148 is provided between the signal side electrode 147 and the PZT elements 11. However, the spring 148 can be provided between the PZT elements or between the PZT elements and the high voltage side electrode 149.

Figure 21:
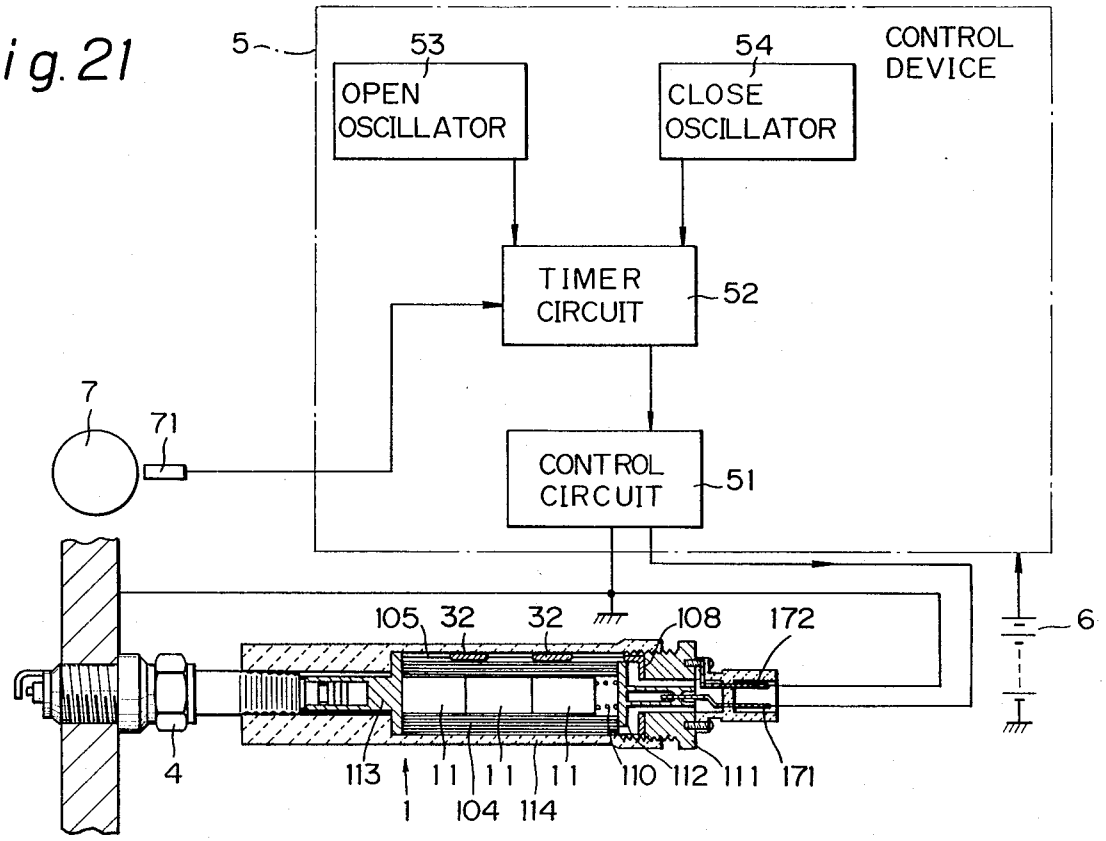
FIG. 21 is a view showing a still further embodiment of the present invention.
Figure 22:
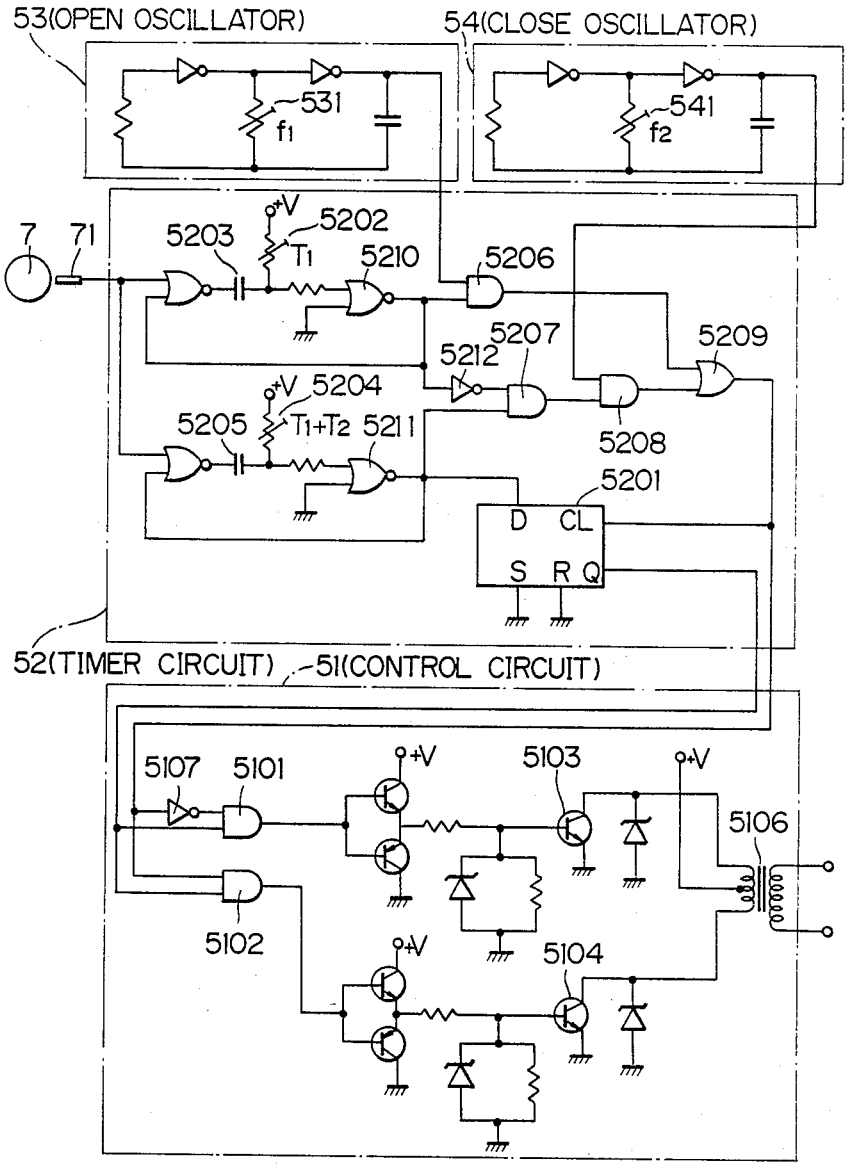
FIG. 22 is a view showing an arrangement of a control in the device shown in FIG. 21.

FIG. 21 shows a spark plug ignition device having a PZT element according to still another embodiment of the present invention, and FIG. 22 shows a control device in the device shown in FIG. 21. In the device shown in FIG. 21, PZT elements 11 have a columnar shape, and are made of known lead zirconium titanate (PZT). These three PZT elements are connected in series with each other, and are housed in an annular hole of a substantially columnar element holder 104.

The element holder 104 is made of an insulative polycarbonate resin, and comprises a groove 105 on a side surface thereof along its axial direction. Diodes 32 are buried in the groove 105, and are potted by an epoxy resin. One end of each diode 32 is connected to a stem holder 113 made of a conductive material and the other end thereof is grounded through an earth ring 108, a cap bottom 111, and a connector pin 172.

The element holder 104 is inserted in a cylindrical housing 114 made of an insulating material. One end of each PZT element is biased by a conductive spring 110, and is electrically connected to a conductive plate 113 and a connector pin 171.

Reference numeral 4 denotes a normal spark plug and has a stem portion supported by a stem holder 113 of an ignition device 1 to maintain conductivity. A control device 5 is connected to a power source 6, the ignition device 1, and a rotating angle sensor 71. The control device 5 comprises a control circuit 51, a timer circuit 52, an open oscillator 53, and a closed oscillator 54.

In the control unit shown in FIG. 22, the control circuit 51, the timer circuit 52, the open oscillator 53, and the closed oscillator 54 are shown. Reference numeral 5201 denotes a flip-flop; and 5202, 5204, 531, and 541, variable resistors.

The operation of the device shown in FIG. 21 will be described hereinafter. The control circuit 51 applies a high frequency alternating voltage to the ignition device 1 at an engine spark timing in response to a signal from the timer circuit 52. When a period of the voltage coincides with a resonance period of the PZT elements 11, the PZT elements 11 are greatly stretched/contracted, thus generating a high voltage. The high voltage is applied to the plug 4 to induce a spark discharge.

When the PZT elements discharge charges accumulated therein, the Young's modulus thereof becomes small. In other words, the PZT elements become soft. In the ignition device 1 shown in FIG. 21, a resonance period thereof is changed before and after the discharge. Thus, the two oscillators are switched to correspond to a change in the resonance period, thus correcting the oscillating period.

The oscillator 53 for the case of non-discharge of a spark plug (opening), and the oscillator 54 for the case of discharge of a spark plug (closing) are oscillated at resonance periods of the PZT elements before and after the discharge, respectively. When the timer circuit 52 receives a discharge start signal from the rotating angle sensor 71, it supplies a signal from the oscillator 53 to the control circuit 51 for a period of 0.1 msec, and subsequently supplies a signal from the oscillator 54 to the control circuit 51.

As a result, the control circuit 51 applies to the ignition device 1 the alternating voltage having the same period as that of the signal from the oscillator 53 for a period of 0.1 msec after supplying the discharge start signal, and thereafter, applies the alternating voltage having the same period as that of the signal from the oscillator 54 to the ignition device 1.

Since it takes 0.1 msec or less for the ignition device 1 to start discharging after being driven, the oscillators are switched immediately after the device 1 discharges.

In this manner, the same resonance state of the ignition device can be maintained before and after the discharge, and a high discharge energy can be obtained.

Figure 23:
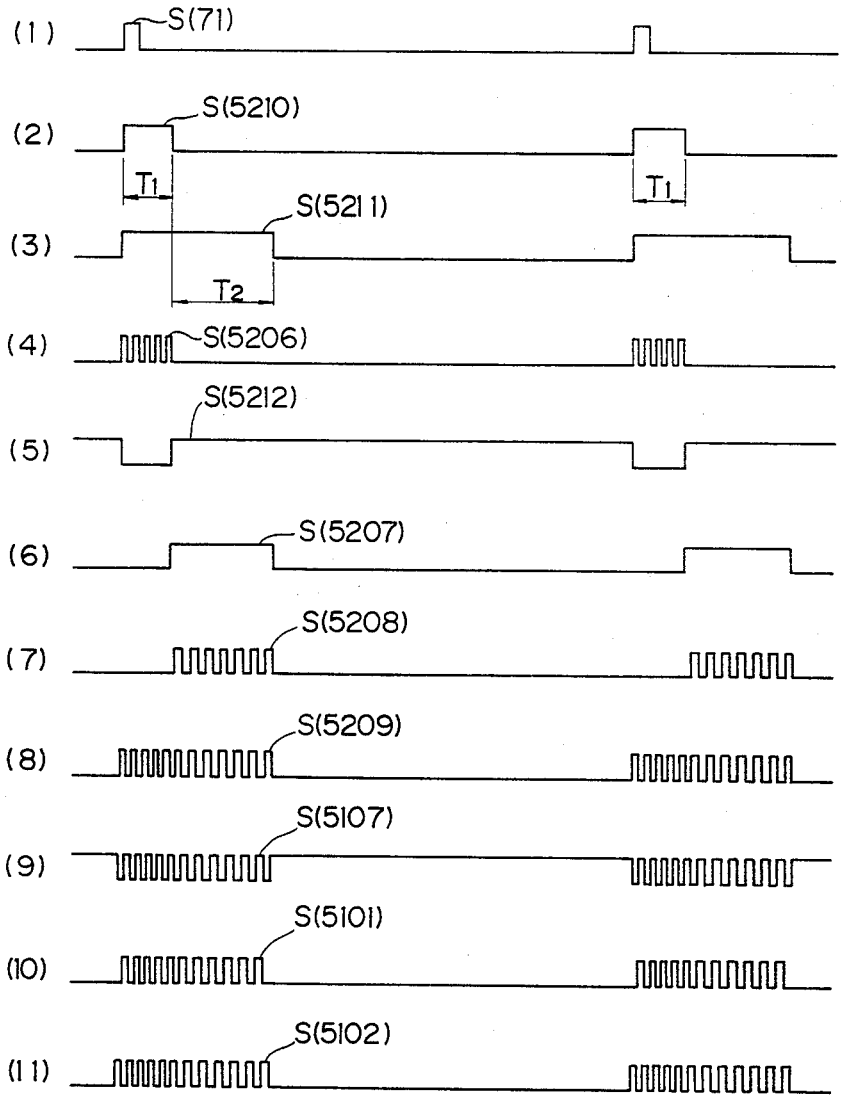
FIG. 23 is a waveform chart showing signal waveforms of respective portions of the device shown in FIG. 22.

The operation of the control circuit 51, the timer circuit 52, the open oscillator 53, and the closed oscillator 54 will be described in more detail with reference to FIGS. 23 and 24. The oscillator comprises a known circuit using two inverter gates. When resistances of the variable resistors 531 and 541 of the open and closed oscillators 53 and 54 are changed, the respective oscillating frequencies f1 and f2 are changed. The variable resistor 5202 and a capacitor 5203 of the timer circuit 52 produce, after a signal S(71) from the rotating angle sensor 71 is generated, a pulse signal for determining a period T1 from when a signal begins to be supplied to the control circuit 51 at the oscillating frequency f1 of the open oscillator 53 until the frequency f1 is switched to the oscillating frequency f2 of the closed oscillator 54. The variable resistor 5204 and capacitor 5205 of the timing circuit 52 produce, after a signal S(71) from the rotating angle sensor 71 is generated, a pulse signal for determining a period T1+T2 shown in FIG. 23(3) from when the signal begins to be supplied to the control circuit 51 until the oscillating frequency is switched and the signal transmission to the control circuit 51 is completed. A signal S(5210) and a signal from the open oscillator 53 are ANDed by an AND gate 5206, thus obtaining an open spark signal S(5206). An inverted signal S(5212) by the inverter and a signal S(5211) are ANDed by an AND gate 5207, thus obtaining a closed period signal S(5207). The signal S(5207) is logically ANDed with the signal from the closed oscillator 54 by the AND gate 5207, thereby obtaining a closed spark signal S(5208). The open spark signal S(5206) and the closed spark signal S(5208) are logically ORed by an OR gate 5209, thus generating a spark signal S(5209), and the signal S(5209) is supplied to the control circuit 51.

The spark signal S(5209) is supplied to the flip-flop 5201 and AND gates 5101 and 5102 together with the inverted signal S(5207) thereof to obtain signals S(5101) and S(5102).

A known push-pull circuit drives a transformer 5106 in response to the signals S(5101) and S(5102). Transistors 5103 and 5104 are power transistors, i.e., field-effect transistors, which can instantaneously control a large current.

Various changes and modifications may be made within the spirit and scope of the invention. For example, in the above embodiment, the PZT elements are pressed by the coil spring. Instead of this, a conductive material having an elasticity such as a conductive rubber or plate spring can be used.

Figure 24:
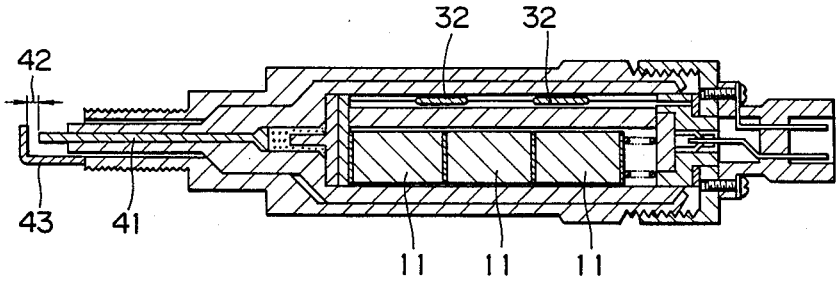
FIG. 24 is a view showing another embodiment.

As shown in FIG. 24, the distal end of the ignition device can be integrally formed as in a normal spark plug.

In the above embodiment, the two oscillators are switched by a timer. Instead of this, a signal generated during discharging, which is usually a noise, may be used for switching the oscillators. Alternatively, frequencies of a single variable frequency oscillator can be switched by a timer or the signal generated during discharging.

FIGS. 25 to 30 show still another embodiment of the present invention. In the device shown in FIG. 25, reference numeral 1000 denotes a plurality of PZT elements having substantially the same resonance periods. Each PZT element 1000 has two parallel surfaces, and electrodes are formed thereon. A plurality of the PZT elements 1000 are connected in parallel. Plate-like PZT materials 1001 and copper electrodes 1010 are alternately stacked, and each copper electrode 1010 has two ends respectively having holes through which electrode bolts 1040 are inserted. A collar 1050 is inserted between each of the electrode bolts 1040 and the copper electrodes 1010 to maintain a distance therebetween. Each electrode bolt 1040 has two ends provided with threaded portions, and one of these threaded portions is screwed in a base 1080 made of an insulating material. A stack comprising the copper electrodes 1010 and the plate-like PZT materials 1001 is mounted on the base 1080, and is biased downward by a compressed spring 1020. One end of the spring 1020 abuts against the upper copper electrode 1010, and the other end thereof abuts against a cover 1070. The cover 1070 has a U-shape, and has a groove in an inner surface of its edge portion. A projection of a side plate 1030 is fitted in the groove of the cover 1070. The other end of the side plate 1030 is fixed to the base 1080. Each copper electrode 1010 is longer than each plate-like PZT material 1001. Therefore, at least the copper electrode 1010 has a portion which is directly exposed in air. The horizontal cross-section of the side plate has a U-shape, and the side plate holds the plate-like PZT materials 1001 therein.

Figures 25, 26:
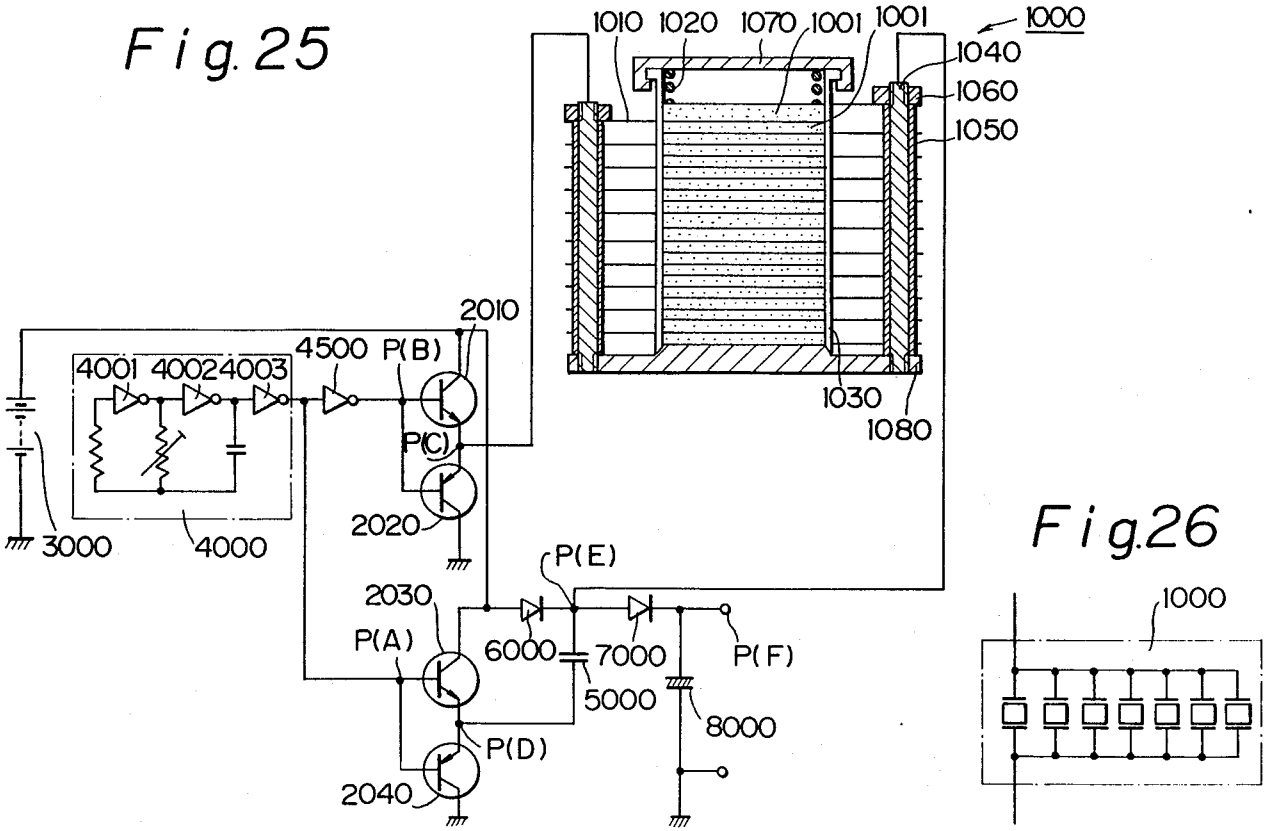
FIG. 25 is a view showing another embodiment of the present invention.
FIGS. 26 to 30 are views for explaining the device shown in FIG. 25.
Figure 27:
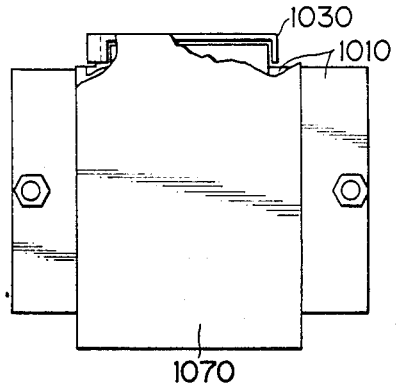

FIG. 26 shows an equivalent circuit of the PZT element portion. Transistors 2010 and 2030 are 2SC or 2SD type power transistors, and transistors 2020 and 2040 are 2SA or 2SB type power transistors. A node between the emitters of the transistors 2010 and 2020 is connected to one of the electrode bolts 1040 of the PZT elements 1000. A node between the emitters of the transistors 2030 and 2040 is connected to the other electrode bolt 1040 through a capacitor 5000. The collectors of the transistors 2010 and 2020 are connected to the positive terminal of a battery 3000, and the collectors of the transistors 2030 and 2040 are connected to the negative terminal thereof. An oscillator circuit 4000 comprises a known inverter-type circuit, and an output therefrom is connected to the bases of the transistors 2010 and 2020 through an inverter 4500 and directly to the bases of the transistors 2030 and 2040. A node between the capacitor 5000 and the PZT elements 1000 is connected to the cathode of a diode 6000 and the anode of a diode 7000. The anode of the diode 6000 is connected to the positive terminal of the battery 3000. The cathode of the diode 7000 is connected to the positive terminal of a capacitor 8000 and the negative terminal of the capacitor 8000 is connected to the negative terminal of the battery 3000.

Figure 28:
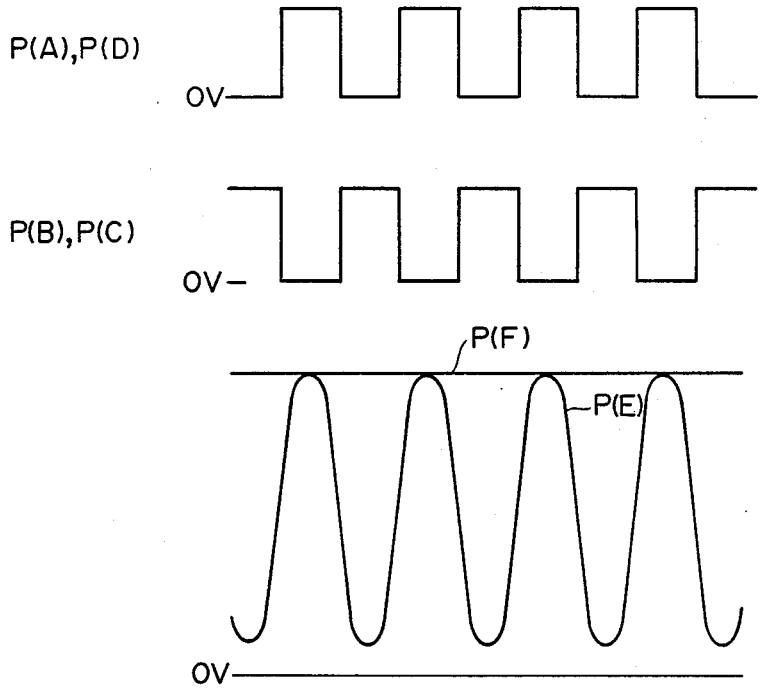
Figure 29:
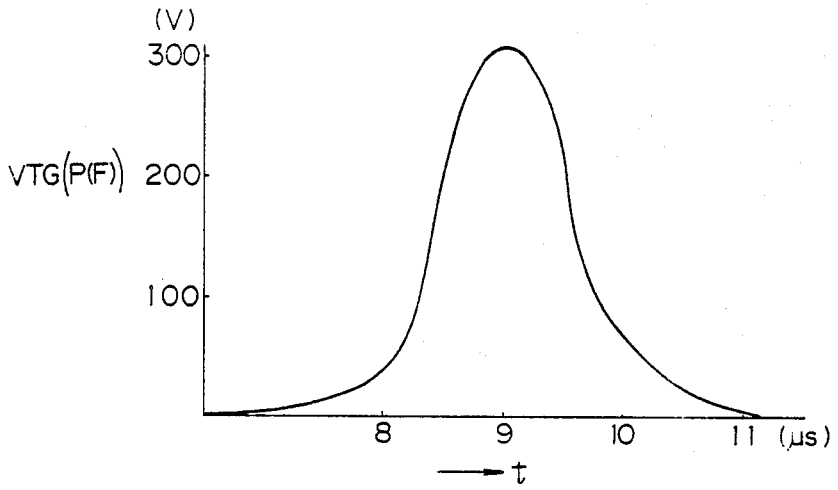
Figure 30:
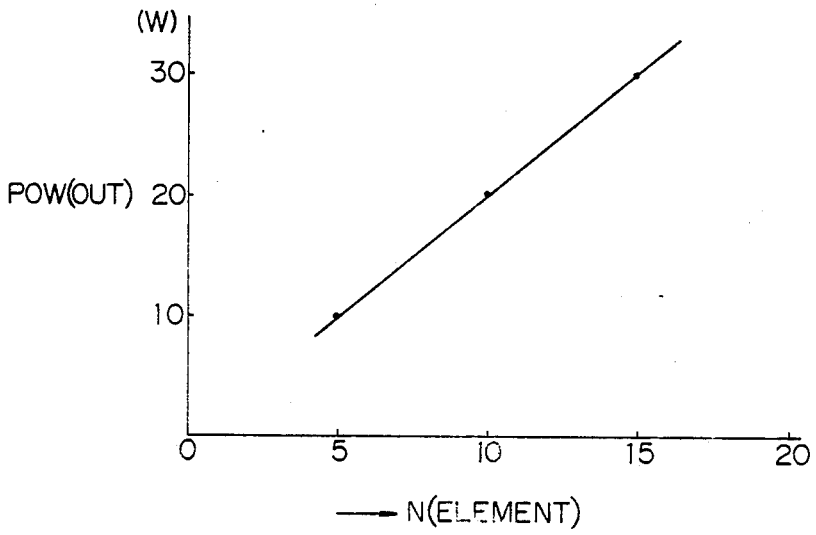

Operation of the device shown in FIG. 25 will be described with reference to FIGS. 28 and 29. An output from the oscillator circuit 4000 can be measured as a rectangular wave at points P(A) and P(D) shown in FIG. 28. A voltage at the point P(A) is an inverted signal of a voltage at the point P(B). When the voltage goes to HIGH level at the point P(A), the transistor 2030 is rendered conductive and a HIGH level voltage is applied to one end (point P(D)) of the capacitor 5000. On the other hand, since the voltage is at LOW level at the point P(B), the transistor 2020 is rendered conductive, and the voltage at a point P(C) of the PZT elements 1000 goes to LOW level. When a phase is opposite to the above-mentioned case, i.e., when the voltage at the point P(A) is at LOW level and the voltage at the point P(B) is at HIGH level, the voltage at the point P(D) is at LOW level and the voltage at the point P(C) is at HIGH level. That is, the rectangular wave voltage is applied to the points P(C) and P(D) in accordance with the oscillating frequency. When this voltage having the oscillating frequency representing the resonance period of the PZT elements 1000 is applied, the voltage at the point P(E) is measured as a voltage 50 to 100 times a battery voltage, as shown in FIG. 28. This voltage represents a sine curve, and its minimum point is equal to the battery voltage. The voltage which is smoothed by the capacitor 8000 through the diode 7000 represents a value which coincides with the maximum value of the point P(E), as in the voltage at the point P(F) in FIG. 28. Note that when a maximum length of the platelike PZT material is 15 mm, the resonance period is 9 μs. This state is shown in FIG. 29. Referring to FIG. 30, an output POW(OUT) is measured as a function of the number N(ELEMENT) of the plate-like PZT materials connected in parallel, and when 10 plate-like PZT materials are provided, the output POW(-OUT) of 20 W can be obtained.

Note that, in the above embodiment, in order to obtain the resonance period of the PZT element, the oscillator circuit 4000 is used. However, the resonance period of the PZT element may change in accordance with a change in temperature. In this case, a PZT element is built in the oscillator circuit as in a known crystal oscillator. With this arrangement, the resonance period can be automatically corrected.

We claim:

1. A high voltage generating device comprising:

piezoelectric element means including at least two columnar-shaped piezoelectric elements having substantially the same resonance periods as one another, connected in series with one another;

an elastic conductive member for applying a pressure to one of said piezoelectric elements;

energizing means, connected electrically with a surface of one of said piezoelectric elements, for supplying said piezoelectric elements with a periodic electric signal having a frequency which is an inherent resonance frequency of said piezoelectric elements; and a capacitive load connected with a surface of the other of said piezoelectric elements.

2. A device according to claim 1, further comprising a capacitor, provided in parallel with said capacitive load.

3. A device according to claim 1, further comprising a diode provided in parallel with said capacitive load or said piezoelectric element means.

4. A device according to claim 1, wherein said capacitive load is a stray capacitance of a spark plug.

5. A device according to claim 1, wherein said conductive elastic member is provided between said piezoelectric elements or between said piezoelectric elements and an electrode.

6. A device according to claim 4, wherein said energizing means is provided with an oscillator circuit for the case of non-discharge of a spark plug and an oscillator circuit for the case of discharge of a spark plug, said oscillator circuit for non-discharge and said oscillator circuit for discharge are oscillated at an oscillation frequency for non-discharge and an oscillation frequency for discharge, respectively, and said oscillator circuit for non-discharge and said oscillator circuit for discharge are alternately operated by switching so as to switch a state wherein energy is discharged from said piezoelectric element means and a state wherein no energy is discharged therefrom.

7. A device according to claim 4, further comprising a capacitor, provided in parallel with said spark plug or said piezoelectric element means.

8. A device according to claim 4, further comprising a diode, provided in parallel with said spark plug or said piezoelectric element means.

* * * * *